US009175558B2

(12) United States Patent
Vornbrock, Jr. et al.

(10) Patent No.: US 9,175,558 B2
(45) Date of Patent: Nov. 3, 2015

(54) SEISMIC NAVIGATION

(75) Inventors: Theodore J. Vornbrock, Jr., Takoma Park, MD (US); Aaron M. Foulk, Woodbridge, VA (US); William Suliga, Manassas, VA (US); Thomas Pepin, Warrenton, VA (US); Michael A. Toreno, Herndon, VA (US); Mark Olender, Alexandria, VA (US); Richard Pitre, Carbondale, CO (US)

(73) Assignee: Raytheon Company, Waltham, MA (US)

( * ) Notice: Subject to any disclaimer, the term of this patent is extended or adjusted under 35 U.S.C. 154(b) by 488 days.

(21) Appl. No.: 13/562,898

(22) Filed: Jul. 31, 2012

(65) Prior Publication Data

US 2014/0034388 A1 Feb. 6, 2014

(51) Int. Cl.
*E21B 47/00* (2012.01)
*E21B 47/022* (2012.01)

(52) U.S. Cl.
CPC ..... *E21B 47/02208* (2013.01)

(58) Field of Classification Search
CPC . E21B 47/02208; E21B 47/091; E21B 46/09; E21B 47/024
See application file for complete search history.

(56) References Cited

U.S. PATENT DOCUMENTS

| | | | | |
|---|---|---|---|---|
| 3,110,347 | A | 11/1963 | Howard et al. | |
| 4,229,122 | A | 10/1980 | Ballantyne | |
| 4,679,637 | A | 7/1987 | Cherrington et al. | |
| 4,775,009 | A | 10/1988 | Wittrisch et al. | |
| 5,119,089 | A | 6/1992 | Khalil | |
| 5,206,840 | A | 4/1993 | Cobbs et al. | |
| 5,363,094 | A * | 11/1994 | Staron et al. | 340/854.6 |
| 5,711,381 | A | 1/1998 | Archambeault et al. | |
| 5,725,059 | A | 3/1998 | Kuckes et al. | |
| 6,135,204 | A | 10/2000 | McCabe et al. | |
| 6,262,945 | B1 | 7/2001 | Maples et al. | |
| 6,294,727 | B1 | 9/2001 | Orlean | |
| 6,363,785 | B1 | 4/2002 | Senghaas et al. | |
| 6,415,824 | B2 | 7/2002 | Stephens | |
| 6,502,634 | B1 | 1/2003 | Evans et al. | |
| 7,000,697 | B2 | 2/2006 | Goode et al. | |
| 7,048,061 | B2 | 5/2006 | Bode et al. | |
| 7,070,359 | B2 | 7/2006 | Richardson et al. | |
| 7,090,013 | B2 | 8/2006 | Wellington | |
| 7,219,729 | B2 | 5/2007 | Bostick, III et al. | |
| 7,270,177 | B2 | 9/2007 | Vercaemer | |
| 7,583,010 | B1 | 9/2009 | Goodemote | |
| 8,286,701 | B2 | 10/2012 | Schultz et al. | |
| 8,534,124 | B2 | 9/2013 | Vornbrock et al. | |
| 2003/0137899 | A1 * | 7/2003 | Hjorth et al. | 367/82 |
| 2003/0146002 | A1 | 8/2003 | Vinegar et al. | |
| 2005/0059957 | A1 | 3/2005 | Campbell et al. | |
| 2005/0098314 | A1 | 5/2005 | Pope et al. | |
| 2008/0000639 | A1 | 1/2008 | Clark et al. | |
| 2009/0122644 | A1 * | 5/2009 | Hjorth | 367/51 |
| 2010/0284250 | A1 * | 11/2010 | Cornish et al. | 367/124 |
| 2012/0063264 | A1 | 3/2012 | Vornbrock et al. | |

* cited by examiner

*Primary Examiner* — Robert E Fuller
*Assistant Examiner* — Steven MacDonald
(74) *Attorney, Agent, or Firm* — Lyudmila Lubashev

(57) ABSTRACT

A sensor array system includes a sensor array comprising a first sensor disposed underground and a second sensor disposed underground, and a processor communicatively coupled to the sensors of the sensor array, the processor operative to receive signals from the sensors of the sensor array indicative of seismic activity, and identify a position of a portion of a borehole machine operative to induce the seismic activity while disposed in an underground borehole.

13 Claims, 7 Drawing Sheets

SEISMIC NAVIGATION

BACKGROUND

The present invention relates to seismic navigation, and more specifically, to providing a method and system for navigating the formation of subterranean boreholes.

Boreholes may be formed using, for example, a horizontal borehole machine. In this regard, FIG. 1 illustrates a prior art example of a borehole machine 102 that uses a bit 104 for excavating earth. The path of the bit 104 may be controlled at the surface 101. Often the bit 104 includes one or more magnetic beacons that, when used in conjunction with a sensor device 106 disposed on the surface 101, may determine the position of the bit 104 while located in a borehole 103. Typically, the sensor device 106 is a portable unit that is moved on the surface 101 over the location of the bit 104 to determine the position of the bit 104 below the sensor device 106. By determining two or more positions of the bit 104, the path of the bit 104 may be calculated. Once the path of the bit 104 is calculated, the path of the bit 104 may be adjusted if desired such that a borehole is formed that follows a desired path.

SUMMARY

According to one embodiment of the present invention, a sensor array system includes a sensor array comprising a first sensor disposed underground and a second sensor disposed underground, and a processor communicatively coupled to the sensors of the sensor array, the processor operative to receive signals from the sensors of the sensor array indicative of seismic activity, and identify a position of a portion of a borehole machine operative to induce the seismic activity while disposed in an underground borehole.

According to another embodiment of the present invention, a method includes receiving signals in a processor indicative of a seismic activity induced by a portion of a borehole machine, determining a position of the portion of the borehole machine, comparing the position of the portion of the borehole machine and a intended path of the portion of the borehole machine, and outputting data indicative of the difference between the position of the portion of the borehole machine and the intended path of the portion of the borehole machine.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION

Figure 1:
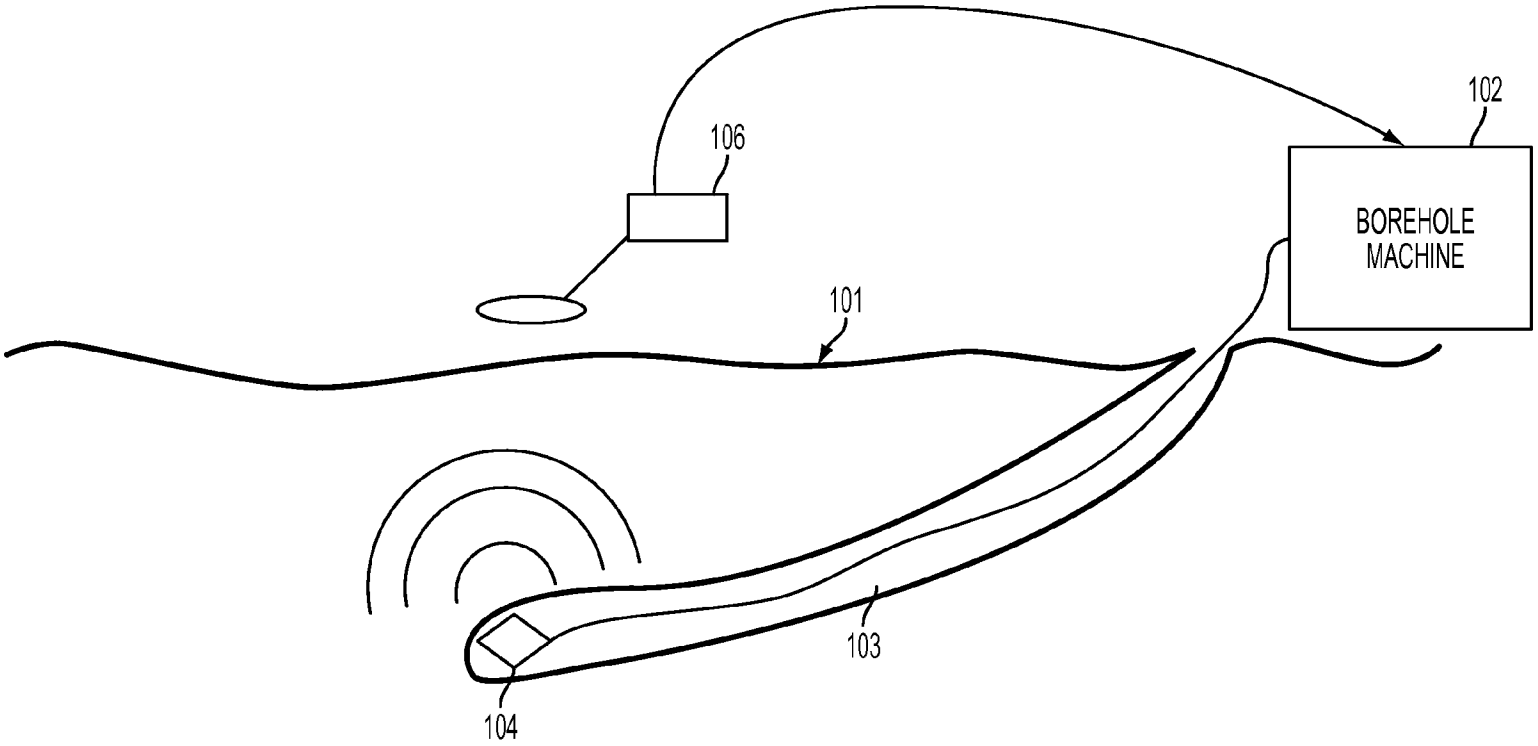
FIG. 1 PRIOR ART
FIG. 1 illustrates a prior art example of a borehole machine.

As discussed above, the prior art system shown in FIG. 1 uses a sensor device 106 that is disposed on the surface 101 above the bit 104. However, if the area of the surface 101 that is above the bit 104 is inaccessible by personnel operating the sensor device 106, the path of the bit may not be determined using the prior art system and methods. The embodiments described below provide a method and system for determining a position and path of a bit that forms a subterranean borehole.

Figure 2:
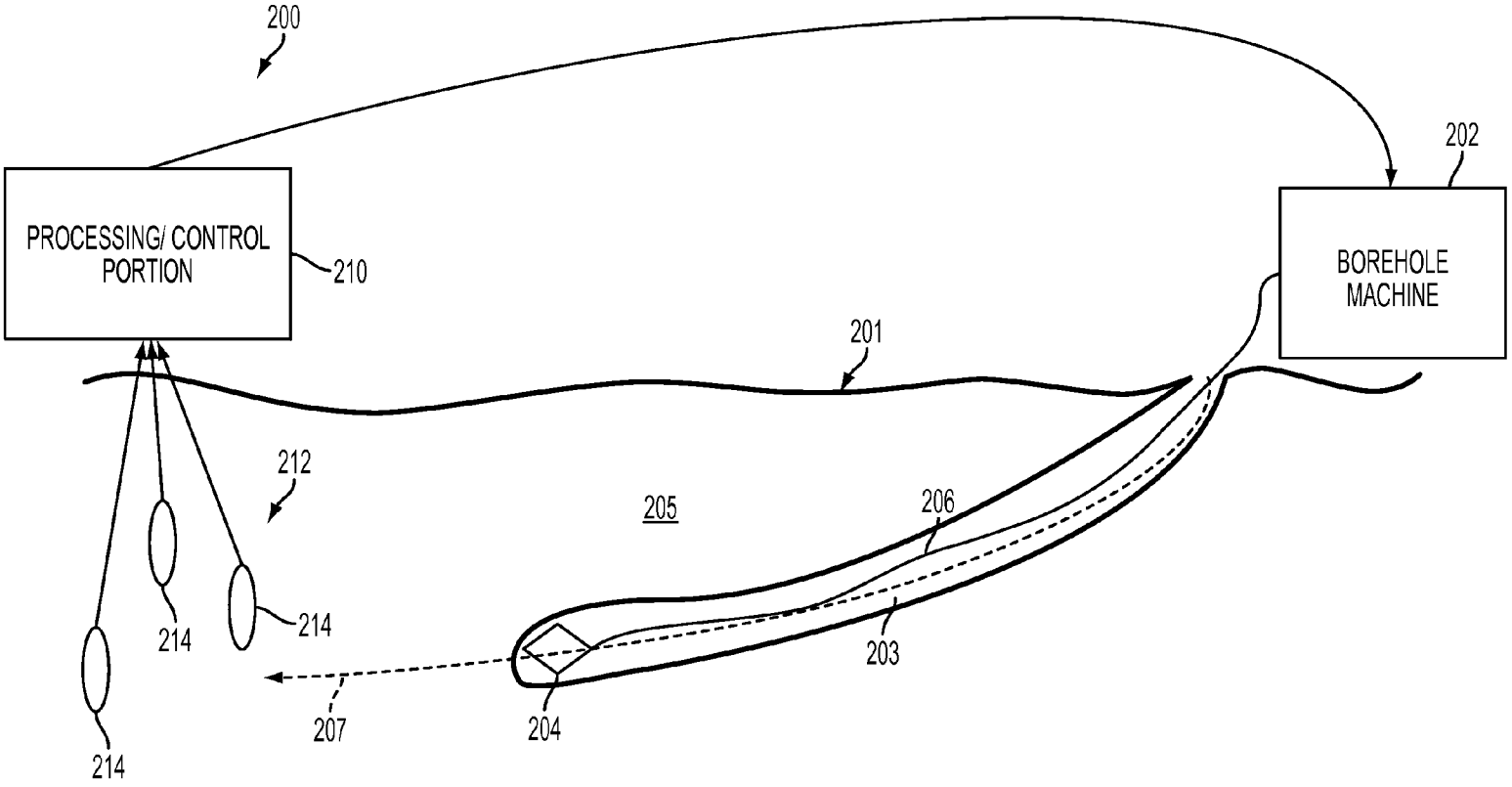
FIG. 2 illustrates an exemplary embodiment of a sensor system.
Figure 3:
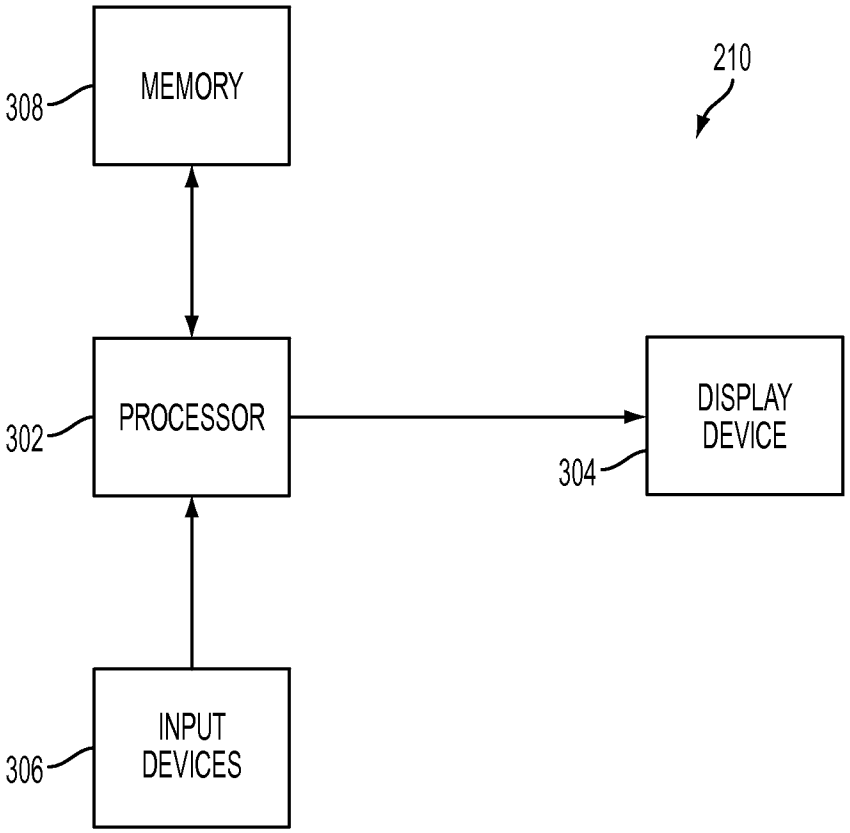
FIG. 3 illustrates an exemplary embodiment of the processing portion of FIG. 2.

FIG. 2 illustrates an exemplary embodiment of a sensor system 200 that is operative to determine a position and path of a bit 204. In this regard, FIG. 2 shows a borehole machine 202 disposed on the surface 201 of terrain 205. The borehole machine 202 includes a bit 204 that is driven with a drill pipe 206 to form a borehole 203 by removing earth from the terrain 205 along an intended path illustrated by the arrow 207. The borehole machine 202 is but one example, and it will be appreciated that any suitable horizontal borehole drilling machine or method may be used in alternate embodiments. The sensor system 200 includes a processing portion 210 that is communicatively connected to a sensor array 212 that includes sensors 214. The processing portion 210 is shown in further detail in FIG. 3, and includes a processor 302 that is communicatively connected to a display device 304, input devices 306 that include, for example the sensors 214 of the sensor array 212, and a memory portion 308. Referring back to FIG. 2, the sensor 214 may include for example, a geophone, a hydrophone, or other types of sensors that are disposed below the surface 201 and are operative to detect seismic activity. The sensor array 212 may include either type of sensors 214 (e.g., geophone or hydrophone sensors) or a combination of both types of sensors. In operation, the sensor array 212 is operative to detect seismic activity caused by the operation of the borehole machine 202, and determine a location of the bit 204 relative to the sensor array 212 as a function of the detected seismic activity. Once the location of the bit 204 relative to the sensor array 212 is determined, the location of the bit 204 relative to the intended path 207 of the bit 204 may be determined. If the bit 204 is not following the intended path 207 recommendations for changing the path of the bit 204 to approach the intended path 207 are sent the borehole machine 202. In this regard, the borehole machine 202 may be controlled by operators who receive the recommendations verbally, or via a communications link. Alternate embodiments include a control system of the borehole machine 202 that receives feedback signals from the processing portion 210 indicative of the position of the bit 204 relative to the intended path 207. The feedback signals are used to control the path of the bit 204 relative to the intended path 207 in, for example, a substantially closed loop control system.

In this regard, the sensor array 212 may detect seismic activity caused by the formation of the borehole (i.e., the drill bit 204 moving earth to form the borehole), alternatively, the drill pipe 206 may be manipulated with, for example, a vibratory mechanism to induce seismic activity that emanates from the proximity of the bit and is detected by the sensor array 212.

Figure 4:
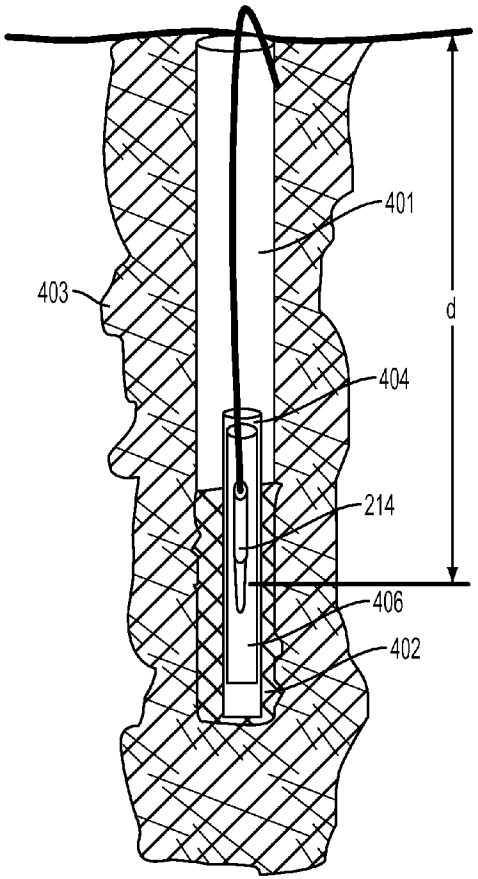
FIG. 4 illustrates an exemplary embodiment of an arrangement of a sensor 214 in a subterranean disposition.

FIG. 4 illustrates an exemplary embodiment of an arrangement of a sensor 214 in a subterranean (underground) disposition. A sensor borehole 401 is formed at a desired depth. The depth of the sensor borehole 401 may be selected based in part on the depth of the planned path of the bit 204 (of FIG. 2). A grout material 402 is disposed in the sensor borehole 401. The grout material 402 may include, for example, a fluid material that will solidify or partially solidify over time, such as, for example, a concrete type material. The properties of the grout material 402 may be selected such that when solidified the grout material 402 will exhibit similar characteristics as the surrounding earth 403. A container 404 such as, for example, a cylindrical pipe having a closed end is placed in the grout material 402. The container 404 has a length that is greater than the depth of the grout material 402 in the sensor borehole 401 such that the open end of the container 404 remains exposed, and the grout material 402 does not enter the inner cavity of the container 404. Once the grout material 402 solidifies or partially solidifies, the sensor 214 is lowered into the sensor borehole 401 and into the container 404 to a desired depth d. The container 404 is filled with a fluid 406. The grout 402 and the fluid 406 that surround the sensor 214 improve the performance of the sensor 214 by improving the transmission of seismic indications (i.e., changes in pressure, or movement) to the sensor 214. The embodiment illustrated in FIG. 4 allows the use of grout 402 and the removal of the sensor 214 from the sensor borehole 401 if desired. If recovery of the sensor 214 is not desired, in alternate embodiments, the sensor 214 may be immersed in the grout material 402 without the use of the container 404 and the liquid 406.

Figure 5:
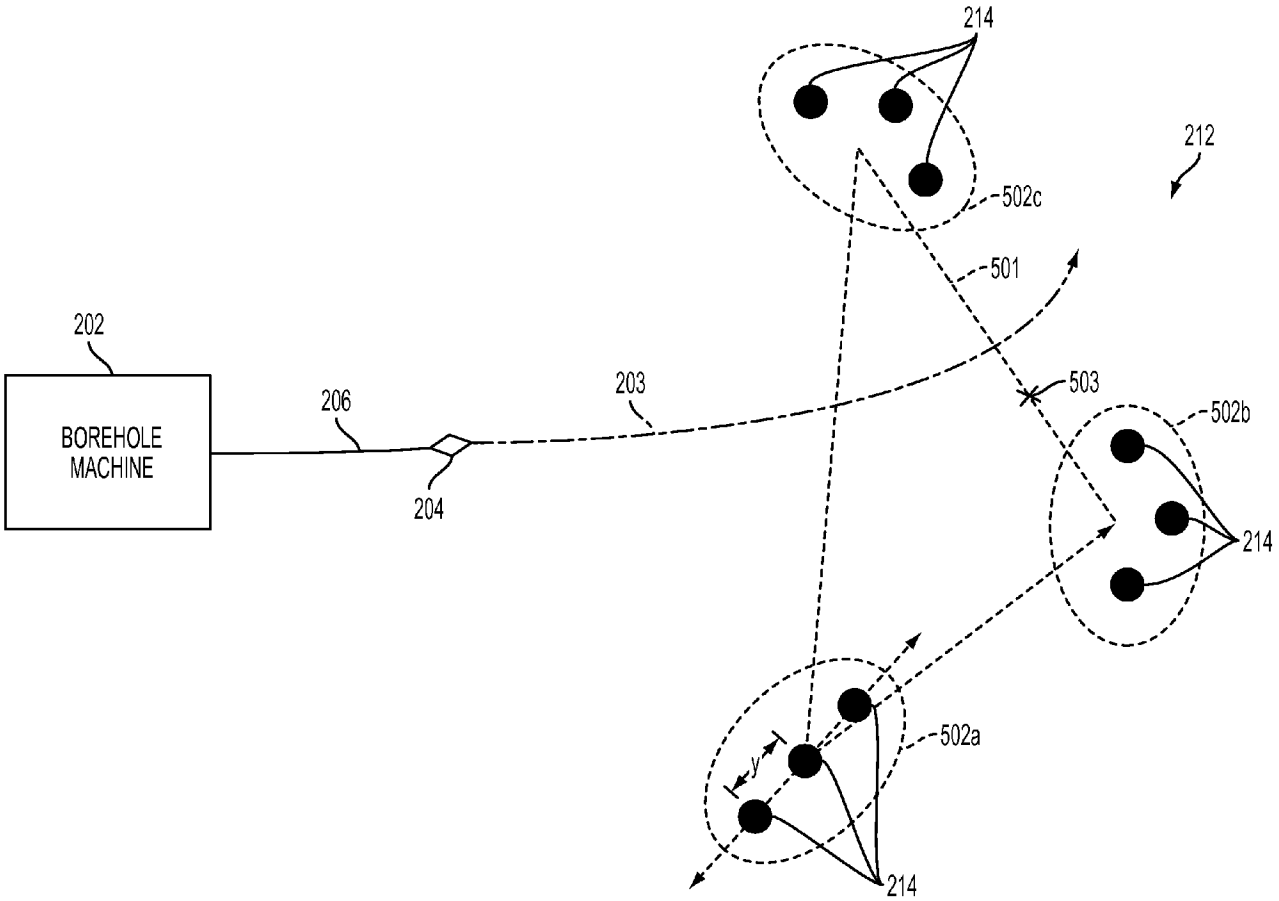
FIG. 5 illustrates a top view schematic of an exemplary arrangement of the sensor array and the borehole machine of FIG. 2.

FIG. 5 illustrates a top view schematic of an exemplary arrangement of the sensor array 212 and the borehole machine 202. The sensor array 212 of the illustrated embodiment includes three groups 502 of sensors 214. The groups 502 are arranged in a pattern. In the illustrated embodiment the pattern is triangular; however, alternate embodiments may include any suitable alternate pattern or number of groups. In the illustrated embodiment, each group 502 includes three sensors 214, however alternate embodiments may include any number of sensors 214 including a single sensor 214 or multiple sensors 214. The sensors 214 may be arranged in any desired configuration in a group 502. For example, the groups 502*b* and 502*c* include sensors 214 arranged in a triangular configuration, while the sensors 214 arranged in the group 502*a* are arranged in a linear configuration. The spacing of each sensor 214 in a group is determined partially by the expected wavelengths of the seismic indications that are sensed by the array 212. The spacing of each group 502 relative to each other is determined by the desired path 203 of the bit 204, and the sensitivity of the sensors 214 in the array. In the illustrated embodiment, the distance between each of the sensors 214 in a particular group 502 is less than the distance between the groups of sensors 502 (e.g., the distance x between sensors 212 in group 502*a* and sensors 212 in group 502*b* is greater than the distance y between the individual sensors 212 in the group 502*a*). The sensitivity of the sensors 214 in the array 212 is partially determined by the type of sensor 214 used, and the type of earth the sensors 214 in which the sensors 214 are disposed. The illustrated embodiment of FIG. 5 is but one example, and other embodiments may include as few as two or three individual sensors 214 that define the array 212.

In this regard, an exemplary array 212 may include two groups (e.g., 502*a* and 502*b*) that are arranged adjacent to the intended path 203. Alternatively, the array 212 may include two groups (e.g., 502*b* and 502*c*) that are arranged such that a plane defined by a plumb line 503 and a line between the two groups 501 intersecting the plumb line.

Figure 6:
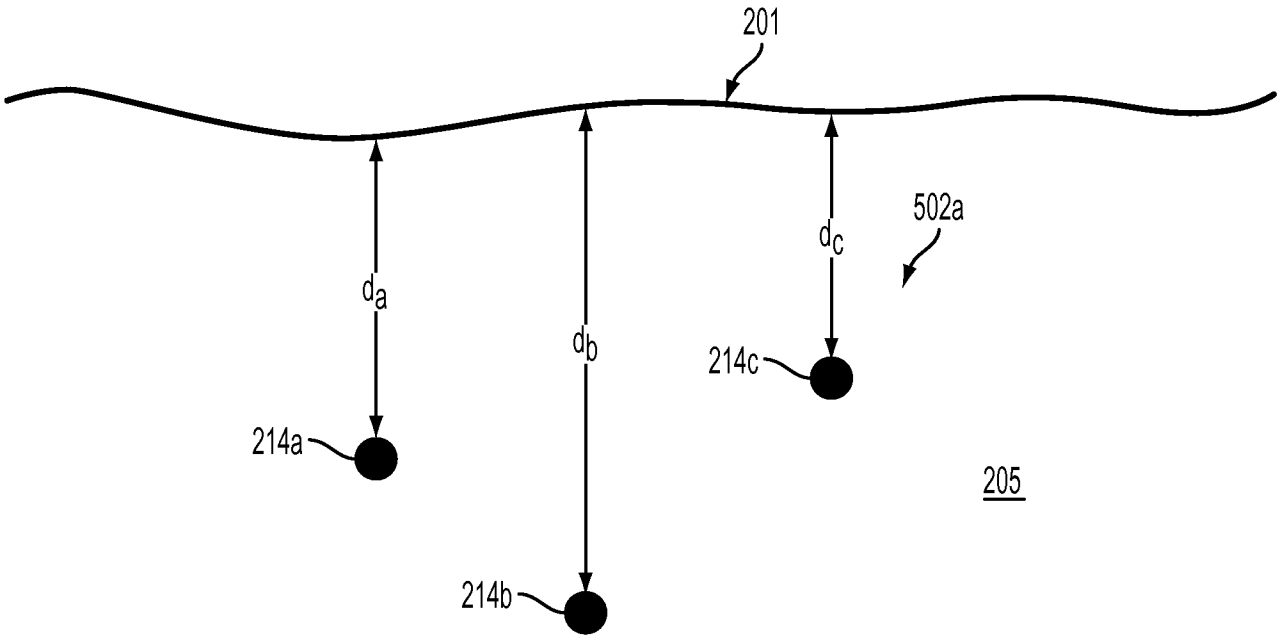
FIG. 6 illustrates a side view of a group of sensors of FIG. 5.

FIG. 6 illustrates a side view of the group 502*a*. In this regard, the sensors 214*a*, 214*b*, and 214*c* are disposed at depths $d_a$, $d_b$, and $d_c$ from the surface 201 respectively. The deposition of the sensors 214 at different depths as opposed to similar depths improves the resolution of the array 214. This improvement is realized by the ability to resolve an otherwise inherent depth ambiguity of the bit 204 relative the depth of the sensors 214 in the array 212. Seismic disturbances originating from locations some distance above and below the sensor array 212 depth will arrive at the sensor 214 locations with identical propagation delays. If all sensors 214 are at substantially the same depth, then it is difficult to determine if a seismic disturbance originated from some distance above or below the array 214 unless additional information is considered. This additional information may include previous drill bit 204 location estimates or the calculate results of a air-ground surface reflection model. If, on the other hand, sensors 214 are placed at various depths then seismic disturbance signals with arrive at one or more before arriving at another.

Figure 7:
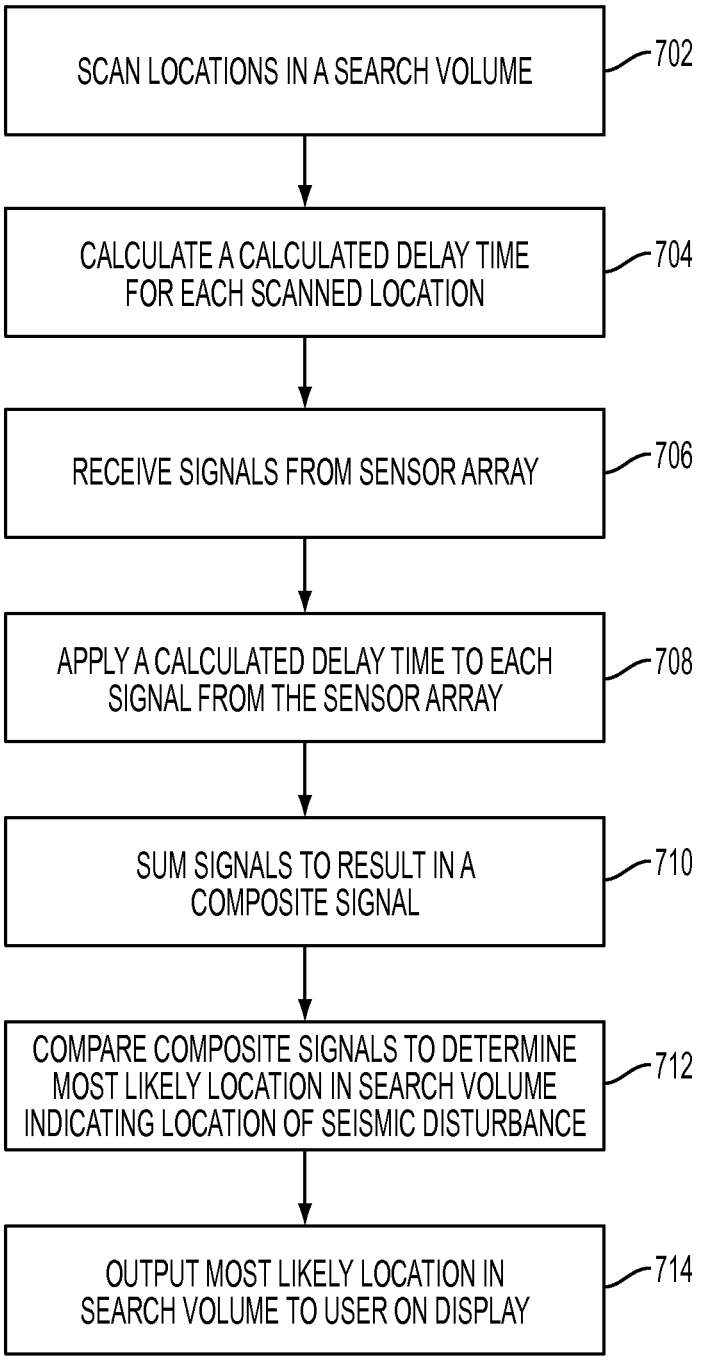
FIG. 7 illustrates a block diagram of an exemplary method for operating the system of FIG. 2.

FIG. 7 illustrates a block diagram of an exemplary method for operating the system 200 (of FIG. 2). In this regard, referring to FIG. 7, the processor repeatedly scans through locations within a desired search volume in block 702. In block 704, for each location a calculated delay time is calculated, representing the time it would take for a "sound" from that location to arrive at each sensor 214 in the array 212. This set of delays—one per sensor—is applied to the electrical or digital signals received from each of the sensors 214 in blocks 706 and 708. This creates a set of signals delayed relative to each other. In block 710, the signals are summed together resulting in one composite signal. After repeating this delay-and-sum algorithm once for each location considered within the search volume, the composite signals may be compared to determine the most likely location within the searched volume responsible for the seismic disturbance sound. (I.e., the location of the bit 204.) The comparison may consider simple features of the composite signals, for example which has the highest amplitude. Alternately, it may consider particular characteristics of the composite signals, for example which composite signal best matches an exemplary "sound-print" of a drill operating in a particular type of soil. In any case, the comparison results in an estimated drill bit 204 location for the time period during which the signals were collected. In block 714, the most likely location in the search volume indicating the location of the source of the seismic disturbance is output to a user on the display device 304 (of FIG. 3).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The corresponding structures, materials, acts, and equivalents of all means or step plus function elements in the claims below are intended to include any structure, Calcmaterial, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated The flow diagrams depicted herein are just one example. There may be many variations to this diagram or the steps (or operations) described therein without departing from the spirit of the invention. For instance, the steps may be performed in a differing order or steps may be added, deleted or modified. All of these variations are considered a part of the claimed invention.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

What is claimed is:

1. A sensor array system comprising:

a sensor array comprising first, second and third distinct groups of multiple proximal sensors disposed underground, at least one of the first, second and third distinct groups of multiple proximal sensors being arranged in a first configuration of sensors and at least another one of the first, second and third distinct groups of multiple proximal sensors being arranged in a second configuration of sensors, which is geometrically distinct from the first configuration of sensors; and a processor communicatively coupled to each sensor of each of the distinct groups of the multiple proximal sensors of the sensor array, the processor operative to receive signals from the sensors indicative of seismic activity, and to identify a position of a portion of a borehole machine operative to induce the seismic activity while disposed in an underground borehole, wherein each sensor in each of the first, second and third distinct group of multiple proximal sensors is respectively disposed in a single, unique borehole.

2. The system of claim 1, wherein the portion of the borehole machine includes a bit disposed in the underground borehole.

3. The system of claim 1, wherein the processor is operative to determine the position of the portion of the borehole machine relative to an intended path of the portion of the borehole machine and output data indicative of the position of the portion of the borehole machine relative to the intended path of the portion of the borehole machine.

4. The system of claim 3, wherein the data is output to a display.

5. The system of claim 3, wherein the data is output to a controller operative to control the borehole machine.

6. The system of claim 3, wherein the intended path of the portion of the borehole machine intersects a plane that contains a line defined by two of the first, second and third distinct groups of multiple proximal sensors.

7. The system of claim 1, wherein at least one of the first, second and third distinct groups of multiple proximal sensors comprises sensors arranged at dissimilar underground depths.

8. The system of claim 1, wherein at least one of the first, second and third distinct groups of multiple proximal sensors comprises first, second and third proximal sensors.

9. The system of claim 1, wherein the first configuration of sensors is a triangular pattern of multiple proximal sensors of varying depth and the second configuration of sensors is a linear pattern of multiple proximal sensors of varying depth.

10. The system of claim 1, wherein each of the first, second and third distinct groups of multiple proximal sensors respectively comprises first, second and third sensors that are closer to each other than to any sensors of any other group.

11. The system of claim 1, wherein the first sensor includes a geophone and the second sensor includes a geophone.

12. The system of claim 1, wherein the first sensor includes a hydrophone and the second sensor includes a hydrophone.

13. The system of claim 1, wherein the first sensor includes a hydrophone and the second sensor includes a geophone.

* * * * *